US005772382A

United States Patent [19]

Raymer

[11] Patent Number: 5,772,382

[45] Date of Patent: Jun. 30, 1998

[54] UNLOADING CONCRETE BEAMS FROM RAILROAD CARS

[75] Inventor: W. Eddie Raymer, Louisville, Ky.

[73] Assignee: Lincoln Industries Corp., Louisville, Ky.

[21] Appl. No.: 547,018

[22] Filed: Oct. 23, 1995

[51] Int. Cl.[6] ..... B60P 1/02

[52] U.S. Cl. ..... 414/339; 105/355; 414/340; 414/495

[58] Field of Search ..... 414/339–341, 414/343, 347, 352, 353, 495, 559; 105/238.1, 355, 392; 410/44

[56] References Cited

U.S. PATENT DOCUMENTS

| | | | |
|---|---|---|---|
| 805,881 | 11/1905 | Ritchie | 414/339 X |
| 2,117,068 | 5/1938 | Ludington | 414/347 X |
| 2,828,027 | 3/1958 | Stevenson et al. | 414/347 X |
| 3,376,988 | 4/1968 | Klosk | 414/339 X |
| 3,561,622 | 2/1971 | Dioguardi | 414/339 |
| 3,730,366 | 5/1973 | Berends | 414/495 |
| 5,120,184 | 6/1992 | Gerawan | 414/495 |

FOREIGN PATENT DOCUMENTS

| | | | |
|---|---|---|---|
| 2840214 | 4/1979 | Germany | 414/353 |
| 1346465 | 10/1987 | U.S.S.R. | 414/339 |

*Primary Examiner*—James W. Keenan
*Attorney, Agent, or Firm*—Nixon & Vanderhye P.C.

[57] ABSTRACT

A railroad car is particularly constructed for transporting heavy elongated structures such as T and box girder pre-stressed concrete bridge beams. The railroad car has a frame including a planar top surface with first and second ends and sides, and railroad wheels mounting the frame for movement on rails. A number of lifting bladders are mounted on the top surface for lifting a beam to move it away from the top surface (e.g. to lift it above a number of wooden blocks supporting the beam). Stationarily mounted roller structures are provided adjacent each of the first and second ends, and movable rollers are provided for movement underneath a beam once lifted by the lifting bladders. A winch is also mounted adjacent each of the ends of the railroad car for pulling beams supported by the rollers along the car, and from one car to the next car to facilitate unloading of the beams (as with a crane) at a discharge site without having to move the railroad cars in a string. A number of different sets of lifting bladders may be provided, adapted for use with different types of beams, and where T-girders are transported movable stops may be pivoted into engagement with the sides of a T-girder to prevent it from tipping over.

20 Claims, 5 Drawing Sheets

UNLOADING CONCRETE BEAMS FROM RAILROAD CARS

BACKGROUND AND SUMMARY OF THE INVENTION

Railroad cars are often used to transport heavy elongated objects, such as prestressed concrete bridge beams, to job sites. In a typical situation, the concrete beams are loaded onto a string of railroad cars (typically as many as ten cars at one time), and they are pulled out to the job site by a locomotive. At the job site a crane will lift the beam from the first car in the string and lay it beside the railroad tracks, or set it in place on a new bridge. The crane cannot reach the beam on the next car back, so the whole train must be moved to a siding so that the now empty car can be switched out, and the next car with the next beam put next to the crane for unloading. However under many circumstances the switch may be many miles away, and it may take two hours or so to set out each car. Using conventional techniques in order to unload a train of concrete beams it can take two or three days, depending upon traffic on the main railroad line.

According to the present invention a railroad car, railroad car assembly, and method of unloading beams or the like from railroad cars, are provided which substantially overcome the drawbacks discussed above with respect to the conventional system. According to the present invention it is possible to remove all of the beams from a string of cars without having to move the string, with a resulting significant savings in time. This is accomplished by mounting the beams on the railroad cars in such a way that—although they will not move during normal transport even when going up or down hills or subjected to rough tracks, it is simple—when desired—to move the beams along the cars so that a beam from each car in the string is moved, in sequence, from that car to the first car, where it is unloaded.

While the invention is particularly applicable for use with T-girder and box girder prestressed concrete bridge beams, it should be understood that the invention is also applicable to other heavy elongated structures, such as other types of beams of metal, concrete, or like materials, component parts of devices (such as vessels, tanks, towers. etc.) to be constructed at a particular job site, or other heavy structures.

According to one aspect of the present invention a railroad car for transporting heavy elongated structures is provided. The railroad car comprises the following components: A frame including a generally planar top surface, first and second ends, and first and second sides. Railroad wheels mounting the frame for movement on rails. A plurality of lifting bladders mounted on the top surface for lifting a heavy elongated structure to move it away from the top surface. Stationarily mounted roller means mounted adjacent at least one of the first and second ends. Movable roller means for movement underneath a heavy elongated structure lifted by the lifting bladders. And, powered linear moving means for moving a heavy elongated structure mounted by the movable roller means along the surface, and into operative association with the stationarily mounted roller means.

The lifting bladders typically comprise conventional air bladders, and they preferably are provided in a first set and a second set different from the first set, with independent controls for controlling the first and second sets of bladders independently. The first set of bladders may be mounted substantially along the centerline of the top surface between the sides, and the second set may comprise a plurality of bladders disposed along a substantially straight line between the centerline and each of the first and second sides of the surface. In this way the center bladders typically are used for T-girders while the second set of bladders are used for box girders.

Preferably stationarily mounted roller means are mounted adjacent each of the first and second ends of the car, and include a top surface for engaging a heavy elongated structure. Preferably a plurality of movable roller means are provided, e.g. at least two and preferably four, and the movable roller means also have a top surface, the top surface of the stationarily mounted roller means being slightly higher than the top surface of the movable roller means. Both types of roller means may comprise any suitable conventional structures including those having wheels, castors, rollers, endless belts extending around rollers, or any other conventional relatively low friction linear movement facilitating structures.

The powered linear moving means may comprise a wide variety of structures such as pneumatic or hydraulic cylinders, electric motors with shafts having traveling nuts, or a wide variety of other conventional structures. Preferred are winches (particularly hydraulic as opposed to electric winches), at least one winch mounted adjacent at least one end of the railroad car top surface, and preferably a winch mounted adjacent each of the ends of the railroad car.

Typically a plurality of wooden blocks are mounted on the top surface for supporting the beams or other heavy elongated structures during transportation so that they do not move while being transported. Where T-girders are to be transported, it is preferred that the railroad car include side-engaging stops mounted on opposite sides of the centerline for movement from a first position engaging the beam mounted on the top surface, to a second position out of engagement with the beam. The side-engaging stops prevent the T-girder beams from tipping over during transportation thereof. Also a stop may be mounted adjacent the stationarily mounted roller or rollers between the stationarily mounted roller and the lifting bladders.

According to another aspect of the present invention a railroad car assembly is provided comprising the following components: A railroad car including a frame having a generally planar top surface, first and second ends, and first and second sides. Railroad wheels mounting the frame for movement on rails. A plurality of lifting bladders mounted on the top surface for lifting a heavy elongated structure to move it away from the top surface. A plurality of blocks mounted or disposed on the top surface and having a heavy elongated structure-engaging surface above the lifting bladders when the lifting bladders are not actuated, so as to support a heavy elongated structure thereon so that the lifting bladders do not engage the structure unless actuated. And, a heavy elongated structure engaging the block support surfaces and movable away from the block support surfaces when the bladders are actuated. The details of the railroad car preferably are as described above.

According to yet another aspect of the present invention a method for unloading heavy elongated objects (such as concrete beams, particularly T-girder and box girder of prestressed concrete bridge beams) is provided. The method comprises the following steps: (a) Moving the string of railroad cars so that the first car of the string is adjacent a discharge site. (b) At the discharge site, removing a heavy elongated structure from the first car of the string. (c) After step (b), without significantly moving the middle or last cars in the string, pushing or pulling a heavy elongated structure from the next car in the string to the first car. (d) Repeating step (b) with the new heavy elongated structure moved to the first car. And, (e) repeating step (c) until a heavy elongated structure on the last car has been moved to the first car, so that substantially all of the heavy elongated structures on the railroad cars in the string have been discharged at the discharge site. Practicing the invention, as compared to the prior art method described above, it is possible to unload all of the beams from a string of railroad cars in much less than half the time of practicing the conventional method.

Step (b) is typically practiced utilizing a crane at the discharge site, although other techniques (including using a heavy duty forklift or forklifts, a device for tilting the car, or the like) may be provided. The cars typically include stationary rollers, winches, and movable rollers as described above, and step (c) is typically practiced for each car as follows: for each car to move a beam off of the car by actuating a plurality of lifting bladders so that the beam is moved out of engagement with the wood blocks; inserting a plurality of movable rollers underneath the beam to support the beam; deactivating the lifting bladders so that the beam moves onto and is supported by the movable rollers; engaging the beam with a cable connected to a winch to pull the beam, supported by the movable rollers, into contact with the stationary rollers at one end of the railroad car, the stationary rollers supporting the beam; and continuing to pull the beam until it is completely off of the railroad car.

It is the primary object of the present invention to provide for the effective transportation of heavy elongated objects, such as concrete bridge beams, on railroad cars, and simple, quick, and effective unloading of a plurality of railroad cars in a string. This and other objects of the invention will become clear from an inspection of the detailed description of the invention and from the appended claims.

DETAILED DESCRIPTION OF THE DRAWINGS

Figure 1:
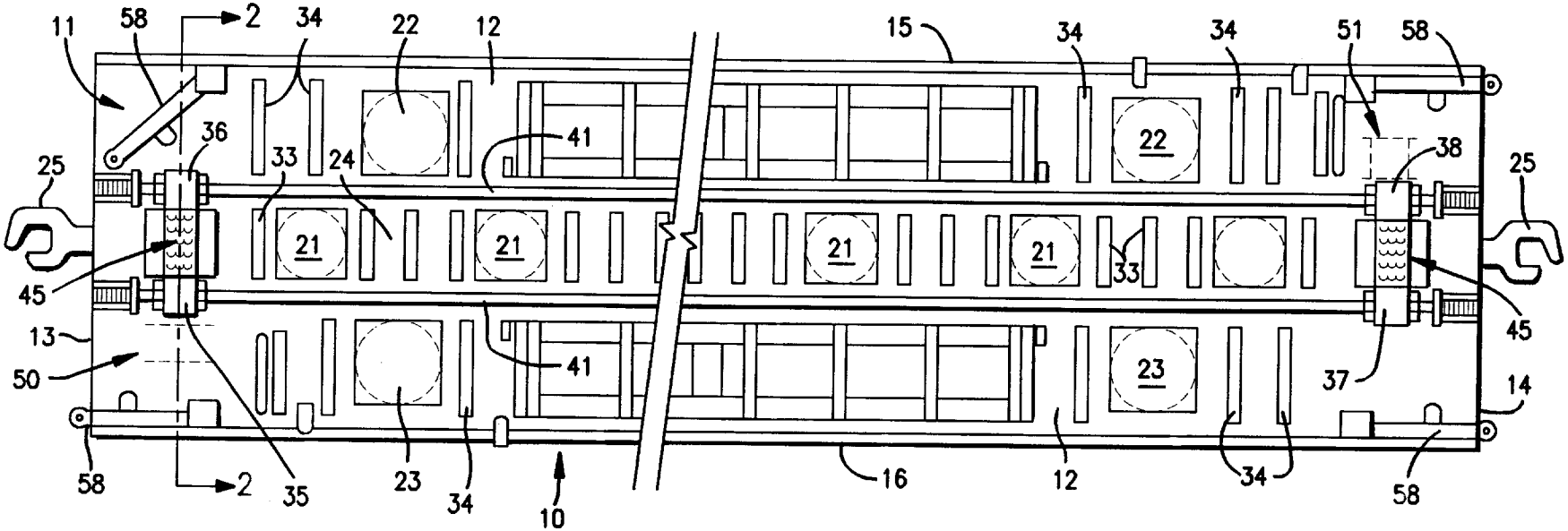
FIG. 1 is a top plan view of an exemplary railroad car according to the present invention.

An exemplary railroad car according to the present invention is shown generally by reference numeral 10 in the drawings. As is conventional for railroad cars, the car 10 according to the invention includes a frame 11 (see FIGS. 2 and 3 in particular) with a generally planar top surface 12, first and second ends 13, 14, and first and second sides 15, 16. Railroad wheels 17 (on conventional trucks schematically illustrated at 18 in FIG. 6) mount the frame 11 for movement on conventional rails 19 (see FIGS. 2, 4, and 7).

Figure 2:
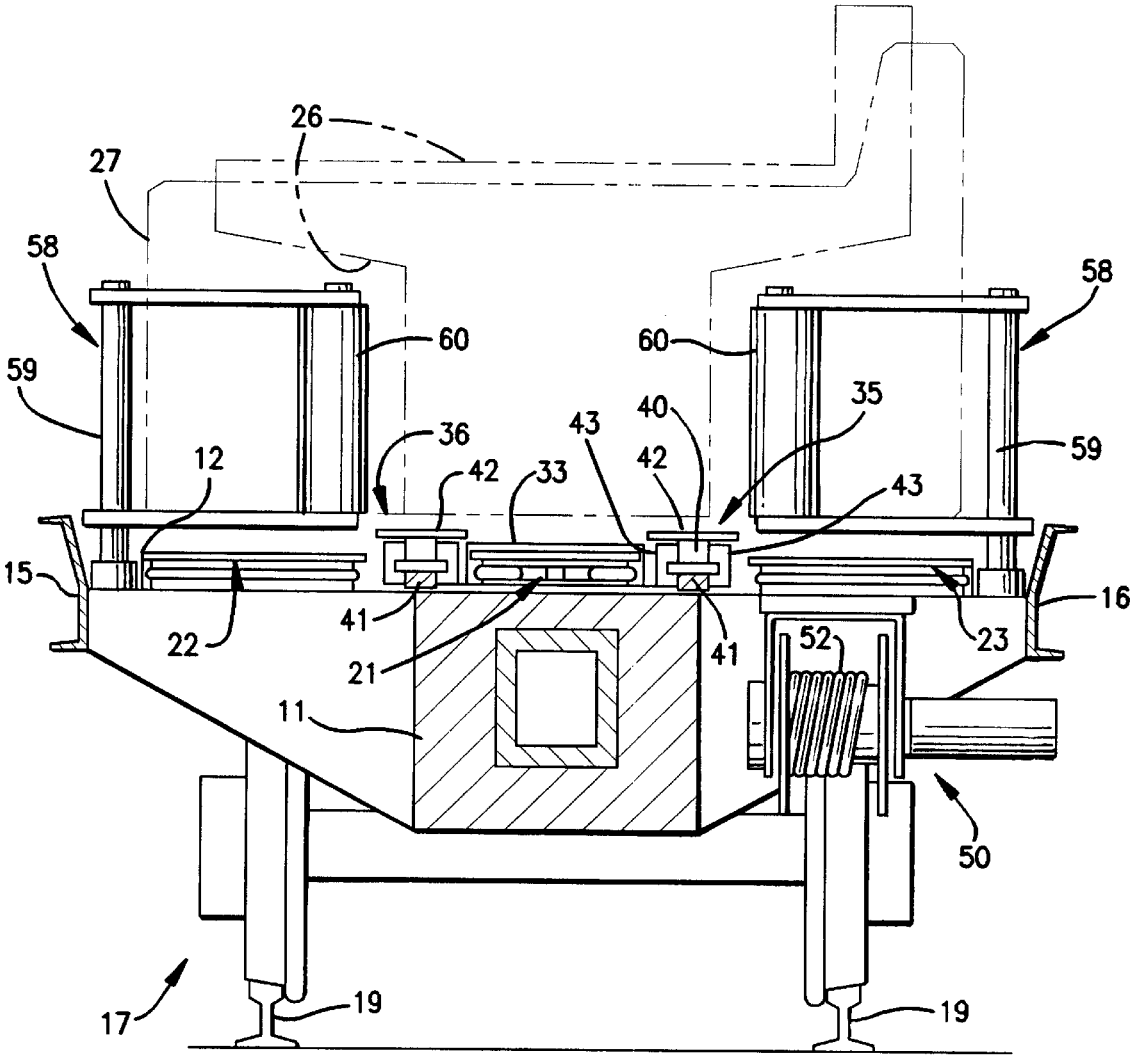
FIG. 2 is a primarily cross-sectional view taken along lines 2-2 of FIG. 1, and showing in dotted line two exemplary types of concrete beams that may be handled according to the present invention.

Mounted on the top surface 12 (either directly on it, or through various supporting or connecting elements) are a plurality of lifting bladders 21, 22, 23, seen most clearly in FIGS. 1 and 2. The lifting bladders 21–23 are per se conventional, and typically air actuated lifting bladders such as available from Firestone Tire and Rubber Company under the trademark AIRSTROKE ACTUATORS, Model #s 119 and 126.

As seen in FIGS. 1 and 2, preferably the bladders 21–23 are in sets. A first set, comprising a plurality of bladders 21, is disposed generally along the centerline 24 of the car 10, that is typically in alignment with the conventional couplers 25. A second plurality of bladders 22 is provided substantially in a straight line parallel to the centerline 24 between the centerline 24 and the first side 15, while a third plurality of bladders 23 is provided in a substantially straight line parallel to the centerline 24 and between the centerline 24 and the side 16. The plurality of bladders 22, 23 comprise a second set of bladders which preferably is controlled independently of the first set 21.

While the exact nature of the bladders 21–23 may differ depending upon the particular heavy elongated structures to be handled thereby, in one preferred embodiment according to the present invention (where T-girders—shown schematically at 26 in FIGS. 2 and 4—are handled), typically between 4–10 (e.g. 5–7) air bladders 21 are provided, being capable upon being supplied with 100 psi compressed air of lifting (with a stroke of about 4.2 inches) about 10,500 lbs. For the air actuators 22, 23 in the second set, typically about eight actuators are provided (four bladders 22 and four bladders 23), the bladders 22, 23 together lifting box girder type prestressed bridge beams (such as shown schematically at 27 in FIG. 2), each having a stroke of about 4.4 inches when supplied with 100 psi air with a lifting force of about 21,000 lbs. each. That is the number of bladders provided for each T-girder 26 or box girder 27 mounted by the railroad car 10 are provided. Where a railroad car 10 has sufficient length between the ends 13, 14 thereof so that it mounts more than one beam 26, 27 (e.g. two to three beams in end to end relationship), about two each of the bladders 22, 23 and about 5–7 each of the bladders 21, are provided for each beam.

Figure 5:
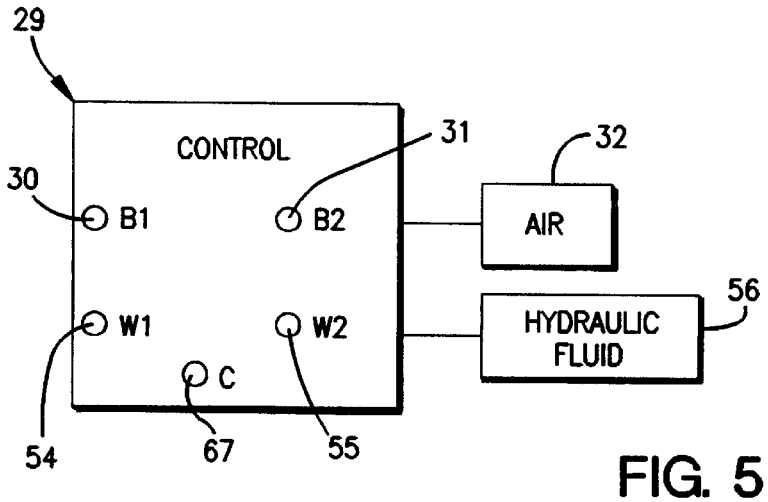
FIG. 5 is a control schematic for a number of the components of the railroad car of FIGS. 1 through 4.

FIG. 5 schematically illustrates a control box 29 which includes one control element (such as a switch) 30 for controlling the first set of bladders 21, and a second control element 31 for controlling the second set of bladders 22, 23, both being provided with air from an approximately 100 psi source of compressed air 32. Of course, various solenoid actuated valves and other controls will be provided as necessary to effect actuation and deflation of the bladders 21–23.

While the bladders 21–23 are for lifting the beams 26, 27, or the like, the bladders 21–23 would have a short life if they had to support the beams 26, 27 during transport by the car 10, since the transportation may be many hundreds or even thousands of miles. Therefore, while the beams 26, 27 are being transported, they are typically supported by a plurality of blocks—normally wooden blocks (or like inexpensive but solid material blocks)—such as shown schematically at 33, 34 in FIGS. 1 and 2. The blocks 33, 34 may be readily removable (e.g. just resting on the surface 12) or held in place by a conventional clamping arrangement, or simple fasteners (e.g. nails of screws). The blocks 33 are dimensioned so that they normally will support a beam 26, 27 above the deflated height of the bladders 21–23. For example, four inch by four inch hardwood blocks 33, 34 are utilized, the shorter blocks 33 the bladders between the bladders 21, and the longer blocks 34 between the bladders 22, 23 respectively.

Of course, it is important during transportation of the beams 26, 27 by the cars 10 that the beams 26, 27 do not move during transportation, for that reason also it is desirable that they rest on the blocks 33, 34. However, when the car 10 arrives at a job sight or the like, and it is desired to roll/push/pull the beams 26, 27 off the car 10, then some mechanisms for supporting the weight of the beams 26, 27 for easy movement is necessary. This is provided according to the preferred embodiment of the present invention by utilizing movable roller means, which provide for movement underneath a beam 26, 27 when lifted by the lifting bladders 21–23.

While any number of roller means may be provided, in the preferred embodiment—as most clearly seen in FIGS. 1 through 4—four separate movable roller devices are provided as the roller means. Two such movable roller means 35, 36 are seen adjacent the first end 13 of the car 10 in FIG. 1, while two other such means 37, 38 are seen adjacent the second end 14 in FIG. 1. The exact nature of the roller means 35–38 according to the present invention is not particularly significant; all that is necessary is that they be able to perform their function of being movable underneath a beam 26, 27 and to allow the beam to be pushed or pulled along the top surface 12 when so supported. For example, conventional Hillman roller carriages (which include ball bearings) may be provided, although almost any other types of structures having wheels, castors, endless belts over rollers, or the like, may be provided.

In the schematic illustration seen in FIGS. 1 through 4, with specific regard to the movable roller means 35, it will be seen that a plurality of ball bearing rollers 40 are provided mounted for movement on a bar or track 41 and supporting a top surface 42, and contained within side supports 43. The bladder 21–23 are capable of lifting the beams 26, 27 to a position where the bottoms thereof are above the top plates or surfaces 42, so that an operator may—typically by hand—merely slide each of the movable roller means 35–38 underneath a beam 26, 27 so that when the bladders 21–23 are deflated (deactivated), the beam 26, 27 will rest on the surfaces 42. By positioning the bars 41 as illustrated most clearly in FIGS. 1 and 2, it is possible to allow movement of the movable rollers 35–38 to unload beams 26, 27 without disturbing the wooden blocks 33, 34 or the bladders 21–23, the surfaces 42 being above the top surfaces of the blocks 33, 34 as seen most clearly in FIG. 2. A beam 26 is seen actually supported by the surface 42 of the movable roller means 36 in FIG. 4.

Figure 3:
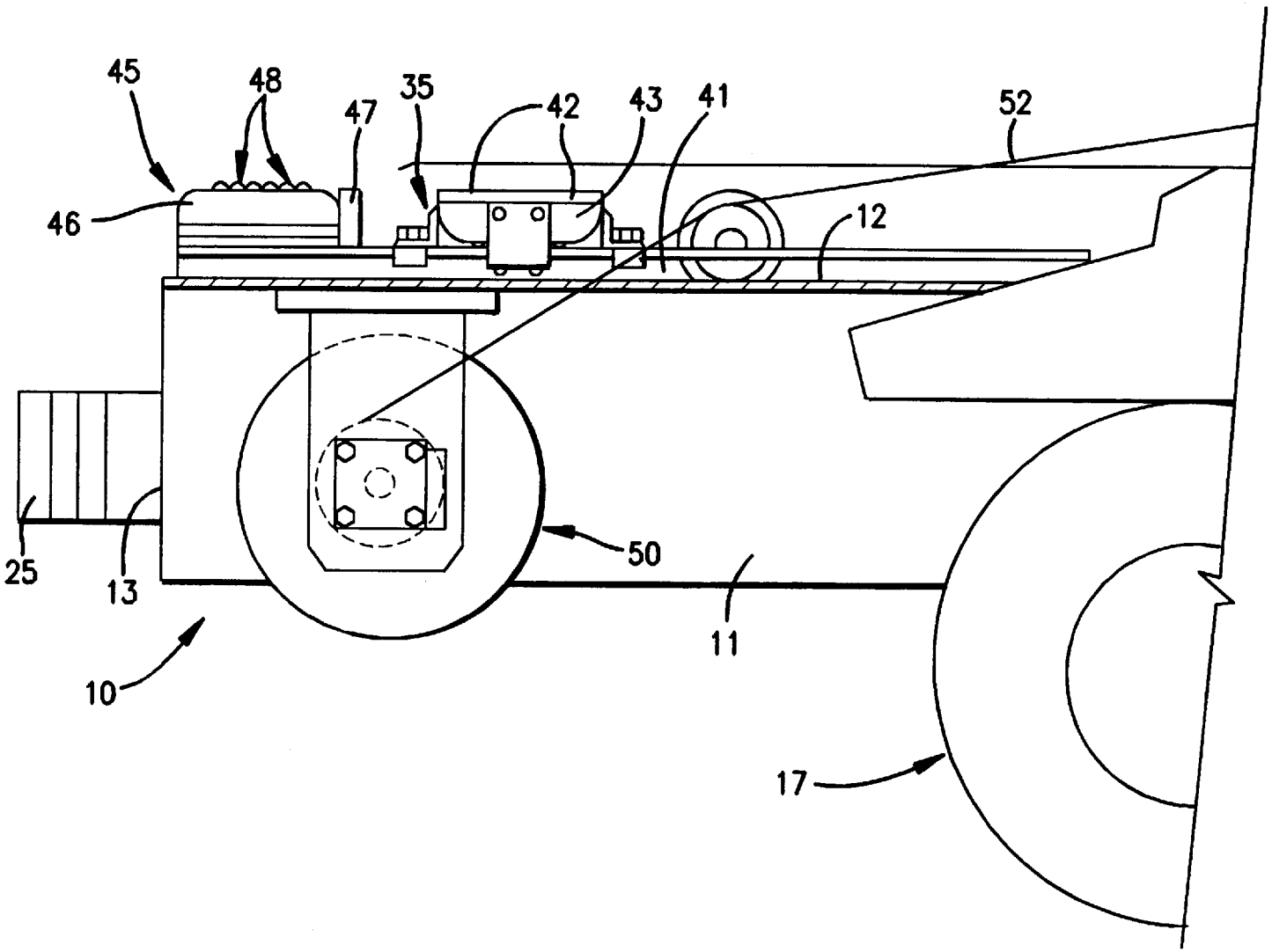
FIG. 3 is a schematic side detail view of the main operative components of the railroad car of FIG. 1.

Also associated with car 10 are stationarily mounted roller means illustrated schematically by reference numeral 45 in FIGS. 1 and 3. The roller means 45 are mounted adjacent at least one of the first and second ends 13, 14 and as illustrated in FIG. 1 preferably adjacent each of the ends 13, 14. The stationarily mounted roller means 45 are preferably straddled by the movable roller means 35–38—as seen in FIG. 1—and may comprise any suitable structure which will allow low friction movement of a beam 26, 27 therealong. For example, in one embodiment a housing 46 (see FIG. 3) may be stationarily mounted to the frame 11 having a stop 47 at one end thereof, and extending upwardly from the top thereof—as illustrated schematically at 48—a plurality of steel rollers mounted for rotational movement about a horizontal axis general parallel to the end 13. However, a wide variety of other means could be provided, such as endless belts around rollers, wheels, castors, or other conventional conveyance elements including very low friction (either self lubricating like polytetrafluoroethylene, or lubricated with extraneous lubricating fluids or gels) planar surfaces. It is preferred that the very top of the elements (e.g. elements 48) associated with the stationarily mounted roller means 45 be positioned so that they are only very slightly above the surfaces 42 of the movable roller means 35–38 straddling them (e.g. about ⅛–½ inch higher) so that once a beam 26, 27 is moved into operative association with the roller means 45 the movable roller means 35–38 no longer play a significant part. The end stops 47 provide a protective function for the roller means 45 in this regard.

The car 10 according to the invention also preferably includes linear moving means for moving the beams 26, 27 mounted by the movable roller means 35, 38 along the surface 12 and into operative association with the stationarily mounted roller means 45. The powered linear moving means preferably are mounted right to the frame 11, and may comprise a wide variety of conventional structures for pushing or pulling, such as hydraulic or pneumatic cylinders, electric motors having shafts with traveling nuts, or other conventional structures. In the preferred embodiment illustrated in the drawings, however, the powered linear moving means preferably comprise at least one winch assembly mounted adjacent at least one of the ends 13, 14. In FIGS. 1 through 3 an exemplary winch assembly 50 is illustrated mounted adjacent the end 13, while a second similar winch assembly 51 is seen only schematically and only in FIG. 1. The winch assemblies 50, 51 may be hydraulically or electrically or pneumatically powered, and preferably are hydraulically powered and of course wrap up or unwind a steel cable 52 (see FIGS. 2 and 3) when rotated about a substantially horizontal axis substantially parallel to the axes of the rollers 48. The winches 50, 51 are conventional and preferably provide both take up and payout functions. For example, if a beam 26, 27 is to be discharged from the car 10 from the first end 13 thereof, the winch 50 will be a take up winch (or a corresponding winch 50 on a previous car 10 in a string), while the winch 51 will be a payout winch. Providing both winch assemblies 50, 51 is particularly desirably where the cars 10 may be on terrain that is anything but completely flat, preventing the beams 26, 27 from "running away".

FIG. 5 schematically illustrates a first winch control 54 for the winch assembly 50, and a second winch control 55 for the winch 51, in this schematic illustration both being provided with hydraulic fluid from the source 56 (which may be mounted on the car 10 or external thereof). Appropriate solenoid control valves and other control elements (not shown) are also typically associated with the control panel 29, winches 50, 51 and the hydraulic fluid source 56.

During the normal transportation of the beams 26, 27, while they will not have a tendency to significantly move on the surface 12 since they are supported by the blocks 33, 34, and are very heavy, e.g. each beam 26, 27 having a weight on the order of about 30,000–80,000 is pounds, to positively hold the beams 26, 27 in place during transport various stops/guides can be provided. For example, as schematically illustrated in FIGS. 1 and 2, powered or latchable stops or guides 58 may be mounted on the surface 12 adjacent one or both ends 13,14 of the car 10. FIG. 1 illustrates three of the guides 58 in the open position which would allow movement of the beams 26, 27, while the upper left guide 58 is shown latched in stopping position, which would retard movement of a beam. The guides/stops 58 are shown in FIG. 2 pivoted about their pivot shafts 59 to a position in which the stop elements 60 thereof would retard movement of the beam 26, 27 off the first end 13 of the car 10.

Figure 4:
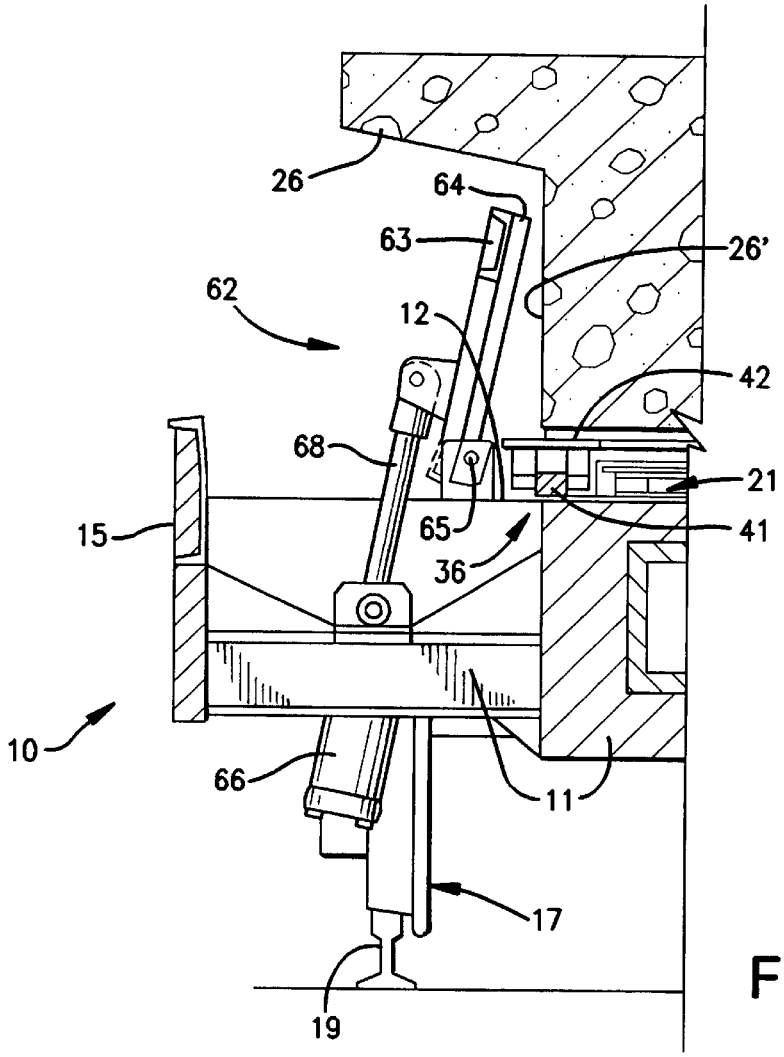
FIG. 4 is a detail end view, partly in cross-section and partly in elevation, showing an exemplary movable beam side support utilizable with T-girders pursuant to the invention.

When T-girders 26 are transported by the cars 10, it is desirable to have some mechanism to insure that the T-girders 26 do not tip over during transportation, for example as a result of vibration or rolling action of the car 10 along the tracks 19. This may be facilitated, according to the present invention, by providing a plurality of stops mounted on opposite sides of the beams 26 and of the center line 24 to prevent tilting. The stop must be movable since it is not needed for the transportation of other types of beams (such as box girders 27). Such a stop is illustrated schematically at 62 in FIG. 4. It includes a side support assembly which may comprise a steel frame 63 with a hardwood or like facing 64 (so that the beam 26 side face 26' will not be gouged or damaged), the frame 63 mounted for pivotal movement about a horizontal pivot point 65. Preferably the frame 63 is pivoted about the pivot point 65 by a hydraulic or pneumatic trunnion mounted cylinder 66 (e.g. preferably a hydraulic cylinder having approximately a six inch bore and approximately a fifteen inch stroke), connected to the frame 11 as schematically illustrated in FIG. 4. A control element 67 (see FIG. 5) is provided on the control console 29 for controlling the cylinder 66 to move the frame 63 from the first position illustrated in FIG. 4) in which it is positioned for engagement of the side surface 26' of the beam 26 (e.g. actually engages the side surface 26' or can easily engage it to support it if the beam 26 tilts during transport) to a second position in which the piston rod 68 of the hydraulic cylinder 66 is withdrawn, and the frame 63 is substantially parallel to the surface 12 and out of the way of any structure that moves over the surface 12. The number of units 62 provided will depend upon the size of the car 10, but typically four such units 62 are provided, two between each of the sides 15,16 and the center line 24, and spaced along the length of the car 10.

Figure 6:
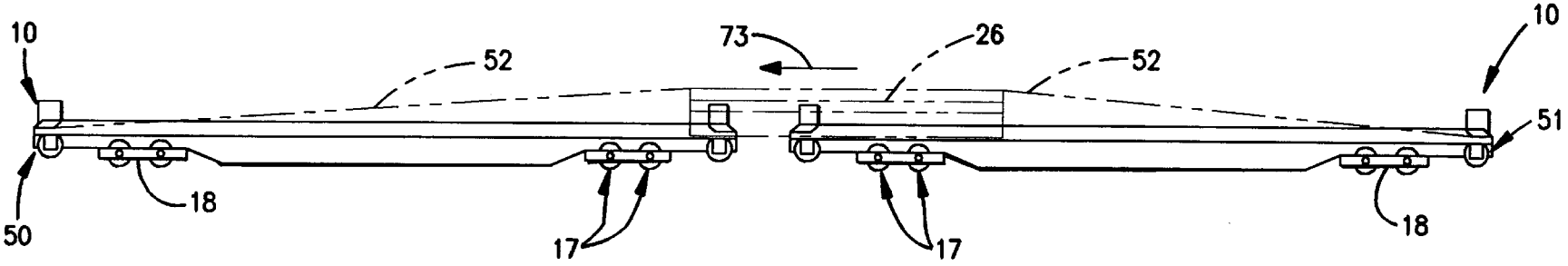
FIG. 6 is a side elevation view schematically illustrating movement of a concrete beam from one car to an adjacent car according to the method of the present invention.
Figure 7:
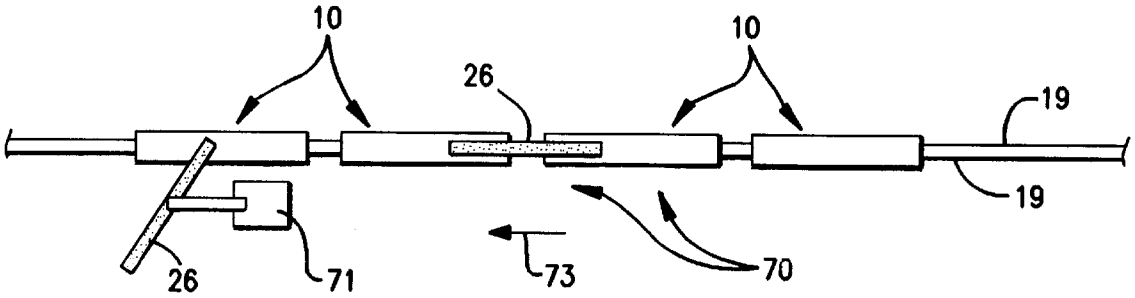
FIG. 7 is a schematic top view illustrating the unloading of concrete beams from a string of railroad cars of FIGS. 1 through 6.

FIGS. 6 and 7 schematically illustrate utilization of cars 10 according to a method of the present invention, for unloading concrete beams 26, 27 at a job site or the like. Typically a plurality of the cars 10 are provided in a string, such as the car string illustrated schematically in FIG. 7, the cars in the string (shown generally by reference numeral 70) coupled together. The cars in the string 70 are moved along the rails 19 to the job site, where discharge of the beams 26, 27 will take place. For example, discharge may be effected by utilizing a crane 71 (see FIG. 7) which removes a beam 26 from the car 10 and either places it on the ground at the discharge site or mounts it in place on a bridge or the like.

The first car 10 in the string 70 (leftmost car in FIG. 7) is unloaded by the crane 71, and then with the rest of the cars of the string 70 still substantially in place (no significant movement thereof being necessary) the beam or beams 26, 27 on the next car 10 in the string (a middle car) are moved onto the first car in the string 70. This is accomplished, for example, with respect to a T-girder 26 by actuating the bladders 21 using control button 30 so that the beam 26 is lifted above the blocks 33 and above the surfaces 42; the operator manually moves the movable roller means 35–38 underneath the beam 26; the bladders 21 are deflated to rest the beam 26 on the surfaces 42 of the movable roller means 35–38; the cable 52 associated with the take up winch 50 on the first car in the string 70 (see the left hand car in FIG. 6 which schematically illustrates the movement of a beam 26 from a middle car to the first car) is connected up to the leading end of the beam 26 by any conventional mechanism (such as tieing it through an opening in the beam 26) while a cable 52 of the payout winch 51 from the middle car 10 is connected up to the rear of the beam 26. Then the winches 50, 51 are controlled, for example using the control buttons 54, 55, to pull the beam 26 in the direction of arrow 73 in FIGS. 6 and 7 so that the beam 26 is moved into operative association with the leftmost stationarily mounted roller means 45 on the middle car and the rightmost stationarily mounted roller means 45 of the leading car 10 (while the payout winch 51 merely prevents "runaway" of the beam 26), until the beam 26 significantly overhangs the first car 10. At that point the movable roller means 35–38 from the first car 10 will be placed under the beam 26, and the powered linear movement of the beam 26 in the direction 73 will continue until the beam 26 is completely supported by the first car 10 in the string 70. Then the cables 52 are detached from it, and the crane 71 lifts the beam 26 off the first car 10.

The above described action is repeated, the beams 26, 27 from each car 10 in the string 70 being moved in the direction of arrow 73 until each has in turn been moved to the first car in the string 70 and is discharged. Where the string 70 is particularly long, of course, beams may be moving from remote middle cars or the end car (the rightmost car 10 in FIG. 7) to cars further up in the string while beams 26, 27 are being conveyed to or toward the first car in the string 70.

Practicing the method as described above it is possible to unload all of the beams 26, 27 (regardless of how many beams are provided per car) in a fraction of the time that it would take utilizing a conventional method, no significant movement of the cars 10 being necessary to effect the unloading process.

It will thus be seen that according to the present invention a simple, yet effective, railroad car, and method of unloading concrete beams or like heavy elongated objects from railroad cars, are provided which are highly advantageous compared to the prior art. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent devices and methods.

What is claimed is:

1. A railroad car for transporting heavy elongated structures, comprising:

a frame including a generally planar top surface, first and second ends, and first and second sides;

railroad wheels mounting said frame for movement on rails;

a plurality of lifting bladders mounted on said top surface for lifting a heavy elongated structure to move it away from said top surface;

stationarily mounted roller means mounted adjacent at least one of said first and second ends;

movable roller means for movement underneath a heavy elongated structure lifted by said lifting bladders; and powered linear moving means for moving a heavy elongated structure which is supported by said movable roller means along said surface, and into association with said stationarily mounted roller means.

2. A railroad car as recited in claim 1 wherein said plurality of lifting bladders comprises a first set of lifting bladders, and a second set of lifting bladders different from said first set, with independent controls for controlling said first and second sets of bladders independently.

3. A railroad car as recited in claim 2 wherein said first set of bladders is mounted substantially along a centerline of said surface between said sides thereof, and wherein said second set of bladders comprises a plurality of bladders disposed along a substantially straight line between said centerline and each of said first and second sides of said surface.

4. A railroad car as recited in claim 3 wherein said stationarily mounted roller means are mounted adjacent each of said first and second ends.

5. A railroad car as recited in claim 4 wherein said stationarily mounted roller means have a top surface for engaging a heavy elongated structure, and wherein said movable roller means has a top surface, said top surface of said stationarily mounted roller means being slightly higher than said top surface of said movable roller means.

6. A railroad car as recited in claim 5 wherein said powered linear moving means comprises at least one winch mounted adjacent at least one end of said railroad car top surface.

7. A railroad car as recited in claim 6 wherein said powered linear moving means comprises first and second winches mounted adjacent said first and second ends, respectively.

8. A railroad car as recited in claim 3 wherein said heavy elongated structure has sides, and further comprising heavy elongated structure side-engaging stops mounted on opposite sides of said centerline for movement from a first position for engagement of a structure mounted on said top surface, to a second position out of operative engagement with a structure mounted on said top surface.

9. An assembly as recited in claim 8 wherein each stop comprises a frame having a heavy structure engaging face that will not gouge or damage said heavy structure, said frame mounted for pivotal movement about a horizontal pivot point, and said frame pivoted about said pivot point by a hydraulic or pneumatic trunnion mounted cylinder connected to said frame.

10. A railroad car as recited in claim 3 wherein said movable roller means comprises at least first and second roller carriages, one disposed on either side of said centerline between said first and second sets of bladders.

11. A railroad car as recited in claim 10 further comprising a stop mounted adjacent said stationarily mounted roller between said stationarily mounted roller and said first and second sets of lifting bladders.

12. A railroad car as recited in claim 1 further comprising a plurality of wood blocks disposed on said top surface.

13. A car assembly comprising:

a car including a frame having a generally planar top surface, first and second ends, and first and second sides;

wheels mounting said frame for movement;

a plurality of inflatable lifting bladders mounted on said top surface for lifting a heavy elongated structure to move it away from said top surface;

a plurality of blocks disposed on said top surface and each having a heavy elongated structure-engaging top surface positioned vertically above said lifting bladders when said lifting bladders are not inflated, so as to support a heavy elongated structure thereon so that said lifting bladders do not engage said structure unless inflated; and a heavy elongated structure engaging said block top surfaces and movable away from said block top surfaces when said bladders are inflated, and comprising at least one T-girder prestressed concrete bridge beam, or box girder prestressed concrete bridge beam; and stationarily mounted roller means mounted adjacent at least one of said first and second ends of said car frame;

movable roller means for movement underneath said heavy elongated structure when lifted by said lifting bladders; and powered linear moving means for moving said heavy elongated structure which is supported by said movable roller means along said top surface of said frame, and into association with said stationarily mounted roller means.

14. An assembly as recited in claim 13 wherein said lifting bladders comprises a first set of lifting bladders, and a second set of lifting bladders different from said first set, with independent controls for controlling said first and second sets of bladders independently.

15. An assembly as recited in claim 14 wherein said first set of bladders is mounted substantially along a centerline of said surface between said sides thereof, and wherein said second set of bladders comprises a plurality of bladders disposed along a substantially straight line between said centerline and each of said first and second sides of said surface.

16. An assembly as recited in claim 13 wherein said blocks are wood.

17. A railroad car as recited in claim 13 wherein said heavy elongated structure has sides, and further comprising heavy elongated structure side-engaging stops mounted on opposite sides of said centerline for movement from a first position for engagement of a structure mounted on said top surface, to a second position out of operative engagement with a structure mounted on said top surface.

18. An assembly as recited in claim 17 wherein each stop comprises a frame having a heavy structure engaging face that will not gouge or damage said heavy structure, said frame mounted for pivotal movement about a horizontal pivot point, and said frame pivoted about said pivot point by a hydraulic or pneumatic trunnion mounted cylinder connected to said frame.

19. A railroad car assembly comprising:

a railroad car including a frame having a generally planar top surface, first and second ends, and first and second sides;

railroad wheels mounting said frame for movement on rails;

a plurality of inflatable lifting bladders mounted on said top surface for lifting a heavy elongated structure to move it away from said top surface;

a plurality of blocks disposed on said top surface and each having a heavy elongated structure-engaging top surface positioned vertically above said lifting bladders when said lifting bladders are not inflated; so as to support a heavy elongated structure thereon so that said lifting bladders do not engage said structure unless inflated;

a heavy elongated structure, having sides, and engaging said block top surfaces and movable away from said block top surfaces when said bladders are inflated; and heavy elongated structure side engaging stops mounted on opposite sides of said centerline for movement from a first position for engagement of a structure mounted on said top surface, to a second position out of operative engagement with a structure mounted on said top surface.

20. An assembly as recited in claim 19 wherein each stop comprises a frame having a heavy structure engaging face that will not gouge or damage said heavy structure, said frame mounted for pivotal movement about a horizontal pivot point, and said frame pivoted about said pivot point by a hydraulic or pneumatic trunnion mounted cylinder connected to said frame.

* * * * *